US010941593B2

(12) United States Patent
Krishnan et al.

(10) Patent No.: US 10,941,593 B2
(45) Date of Patent: Mar. 9, 2021

(54) FRONT TRUNK LATCH EXTERIOR RELEASE SYSTEM

(71) Applicant: Ford Global Technologies, LLC, Dearborn, MI (US)

(72) Inventors: Venkatesh Krishnan, Wayne, MI (US); Thomas Michael Herline, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 585 days.

(21) Appl. No.: 15/833,438

(22) Filed: Dec. 6, 2017

(65) Prior Publication Data

US 2019/0169890 A1 Jun. 6, 2019

(51) Int. Cl.

| | |
|---|---|
| ***E05B 83/26*** | (2014.01) |
| ***E05B 79/20*** | (2014.01) |
| ***E05B 83/24*** | (2014.01) |
| ***E05B 81/90*** | (2014.01) |
| *E05B 83/34* | (2014.01) |

(52) U.S. Cl.

CPC ..... *E05B 83/26* (2013.01); *E05B 79/20* (2013.01); *E05B 81/90* (2013.01); *E05B 83/24* (2013.01); *E05B 83/34* (2013.01)

(58) Field of Classification Search

CPC ..... E05B 83/24; E05B 79/20; E05B 83/16; E05B 83/26; E05B 83/34; Y10S 292/14; Y10S 292/43; Y10S 292/65; Y02T 90/14; Y02T 90/12; B60K 15/05; E05C 19/10

See application file for complete search history.

(56) References Cited

U.S. PATENT DOCUMENTS

| | | | | |
|---|---|---|---|---|
| 6,109,670 | A * | 8/2000 | Tomaszewski | E05B 83/24 292/216 |
| 6,480,103 | B1 | 11/2002 | McCarthy et al. | |
| 6,666,483 | B2 * | 12/2003 | Baniak | E05B 83/24 292/123 |
| 7,341,289 | B2 | 3/2008 | Schretzlmeier et al. | |
| 8,505,987 | B2 | 8/2013 | Browne et al. | |
| 8,690,591 | B2 | 4/2014 | Charnesky et al. | |
| 8,798,858 | B2 | 8/2014 | Zysk | |
| 8,935,053 | B2 | 1/2015 | Wheeler et al. | |
| 9,327,593 | B2 | 5/2016 | Minock | |
| 9,950,635 | B1 * | 4/2018 | Trego | B60L 53/16 |
| 2010/0237632 | A1 * | 9/2010 | Browne | E05B 81/14 292/201 |
| 2012/0313580 | A1 * | 12/2012 | Charnesky | H01R 13/6397 320/109 |
| 2014/0015258 | A1 * | 1/2014 | Barczynski | E05B 83/24 292/100 |
| 2016/0076279 | A1 * | 3/2016 | Ilea | B60J 7/201 292/220 |
| 2017/0058575 | A1 | 3/2017 | Farooq et al. | |

* cited by examiner

*Primary Examiner* — Mark A Williams

(74) *Attorney, Agent, or Firm* — David Coppiellie; Carlson, Gaskey & Olds, P.C.

(57) ABSTRACT

A front hood latch release system includes a primary latch and a secondary latch securing the front hood. A first handle is disposed within a vehicle cabin and linked to actuate the primary latch. An emergency handle is disposed within a compartment covered by the front hood and linked to actuate the primary latch. A secondary handle is accessible from outside the vehicle cabin and linked to actuate the secondary latch.

10 Claims, 4 Drawing Sheets

FRONT TRUNK LATCH EXTERIOR RELEASE SYSTEM

TECHNICAL FIELD

This disclosure relates to a latch release system for a front storage compartment that enables opening from an exterior of the vehicle.

BACKGROUND

Vehicles are increasingly utilizing alternate propulsion systems. The alternate propulsion systems may be positioned in other locations within the vehicle such that additional space in the front of the vehicle is usable for storage. The front hood of a vehicle includes a latch to secure the hood. A latch for a front compartment is required to prevent opening when a vehicle is above a predetermined speed. Additionally, any compartment that is large enough for a person is required to have a means of releasing the latch from within the compartment.

SUMMARY

A front hood latch release system according to an exemplary aspect of the present disclosure includes, among other things, a primary latch and a secondary latch securing the front hood. A first handle is disposed within a vehicle cabin and linked to actuate the primary latch. An emergency handle is disposed within a compartment covered by the front hood and linked to actuate the primary latch. A secondary handle is accessible from outside the vehicle cabin and linked to actuate the secondary latch.

In a further non-limiting embodiment of the foregoing front hood latch release system, the first handle and the emergency handle are coupled to a common link for actuating the primary latch.

In a further non-limiting embodiment of any of the foregoing front hood latch release systems, the common link includes a split Bowden cable including a first end attached to the primary latch, second end attached to the first handle and a third end attached to the emergency handle.

In a further non-limiting embodiment of any of the foregoing front hood latch release systems, the secondary latch is actuated only by the secondary handle.

In a further non-limiting embodiment of any of the foregoing front hood latch release systems, the secondary handle includes a t-shaped handle coupled to the secondary latch through a flexible link.

In a further non-limiting embodiment of any of the foregoing front hood latch release systems, the secondary handle is disposed within a closable compartment accessible from outside the vehicle cabin.

In a further non-limiting embodiment of any of the foregoing front hood latch release systems, the closable compartment covers a charging port.

In a further non-limiting embodiment of any of the foregoing front hood latch release systems, a Bowden cable is linked between the emergency handle and the secondary latch.

In a further non-limiting embodiment of any of the foregoing front hood latch release systems, the primary latch releases the front hood only to a partial open position and the secondary latch releases the front hood to allow complete opening of the front hood such that the front hood may be moved to the fully open position only upon release of both the primary latch and the secondary latch.

In a further non-limiting embodiment of any of the foregoing front hood latch release systems, a powered actuator is coupled to the primary latch. The first handle and the emergency handle include switches for actuating the actuator to release the primary latch.

In a further non-limiting embodiment of any of the foregoing front hood latch release systems, a controller coupled to the powered actuator and the switches of both the first handle and the emergency handle for controlling release of the primary latch with the powered actuator.

A method of securing a front hood of a motor vehicle according to an exemplary aspect of the present disclosure includes, among other things, coupling a primary latch to a first handle disposed within a vehicle cabin and an emergency handle disposed within a compartment covered by a front hood. A secondary latch is coupled to a secondary handle disposed in a closed compartment accessible from outside the vehicle cabin. The primary latch is released responsive to actuation of either the first handle or the emergency handle. The secondary latch is released responsive to actuation of the secondary handle from outside the vehicle cabin.

In a further non-limiting embodiment of the foregoing method, actuation of both the primary latch and the secondary latch are required to fully open the front hood.

In a further non-limiting embodiment of any of the foregoing methods, the first handle and the emergency handle include switches that prompt a controller to drive an actuator coupled to the primary latch to release the primary latch.

In a further non-limiting embodiment of any of the foregoing methods, the closed compartment including the secondary handle is not accessible from within the compartment covered by the front hood.

The various features and advantages of this disclosure will become apparent to those skilled in the art from the following detailed description. The drawings that accompany the detailed description can be briefly described as follows.

DETAILED DESCRIPTION

Figure 1:
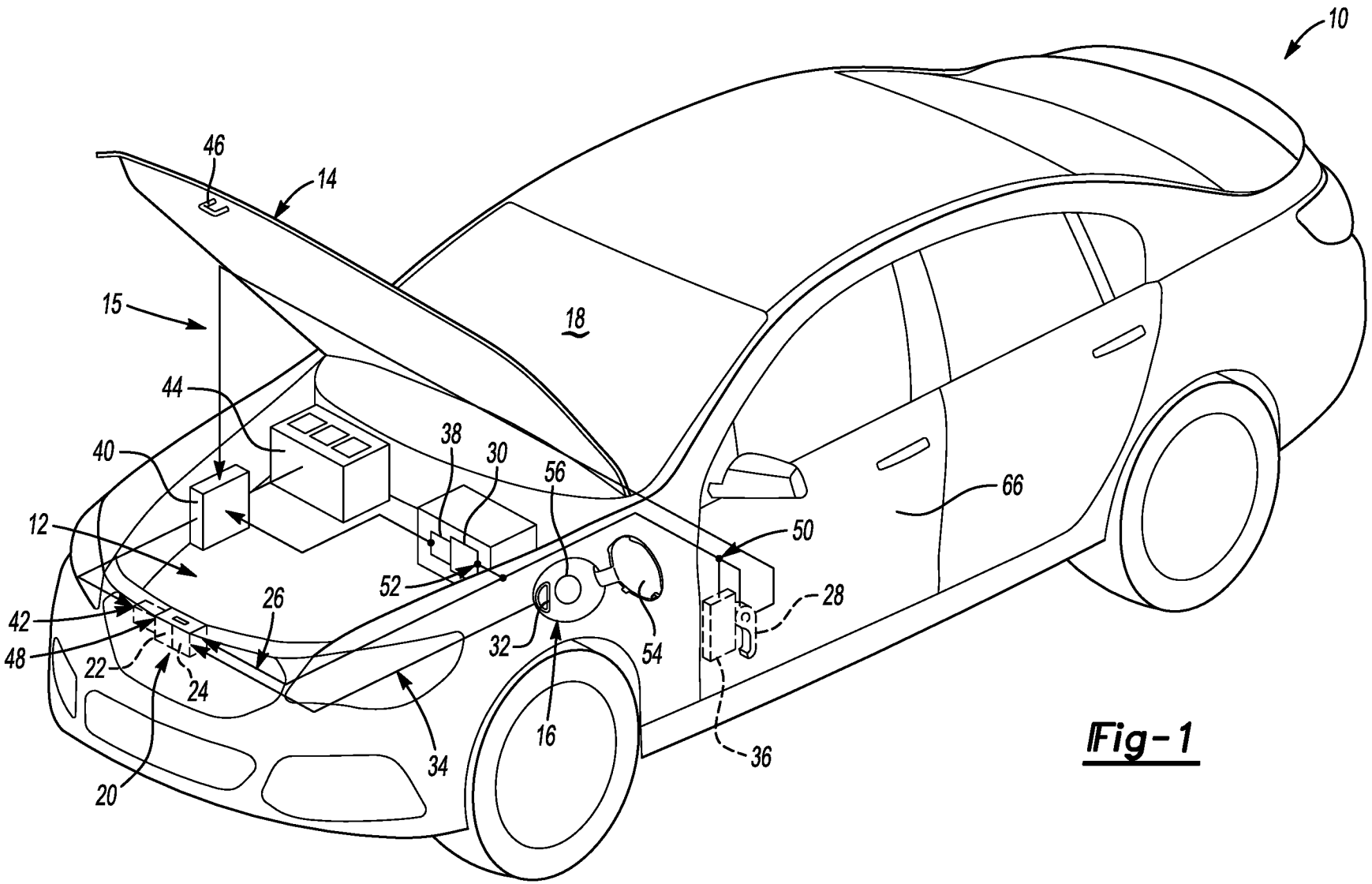
FIG. 1 is a schematic view of a vehicle including an example front hood latch release system.

Referring to FIG. 1, a vehicle 10 includes a front compartment 12 that is covered by a front hood 14. The front hood 14 includes a catch 46 that latches to a latch assembly 20. The latch assembly 20 includes a primary latch 22 and a secondary latch 24. The example front compartment 12 does not include an engine and is large enough to hold a person. The latch assembly 20 is actuatable by a first handle 28 that is disposed within a vehicle cabin 18.

Because the front compartment 12 is large enough to hold an occupant, it must be able to be released from within the compartment 12. Additionally, because the hood 14 is at a front of the vehicle, it must include a secondary latching system that cannot be actuated when the vehicle is travelling above a predefined speed.

The example latch release system 15 includes features that enable actuation of the primary latch 22 from within the vehicle compartment 12 and the vehicle cabin 18. However, release of the primary latch 22 does not allow full opening of the hood 14. Before the hood 14 can be fully opened, the secondary latch 24 must be actuated. The example hood release system 15 includes a secondary handle 32 that is actuatable to release the secondary latch 24 and allow opening of the hood 14. The secondary handle 32 is accessible from a point outside of the vehicle cabin 18. In this disclosed example, the secondary handle 32 is disposed within the closable compartment 16 that is accessible from outside of the vehicle 10.

Figure 2:
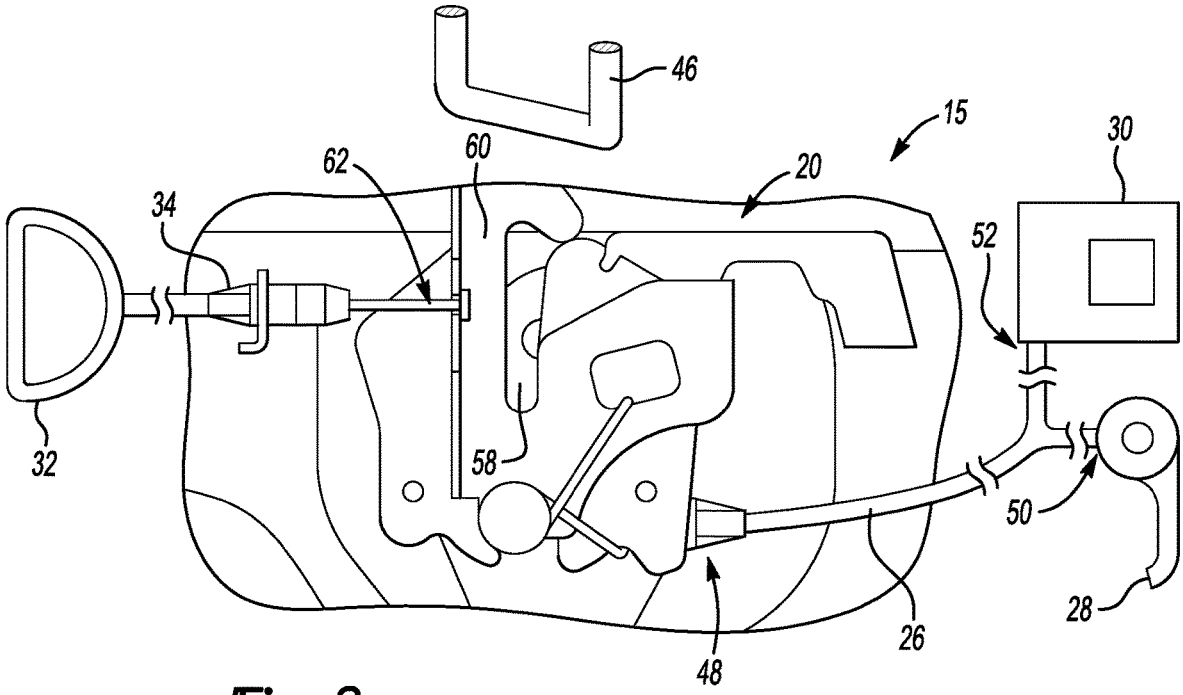
FIG. 2 is a schematic view of the example latch assembly.

Referring to FIG. 2 with continued reference to FIG. 1, the example latch assembly 20 includes a primary catch 58 and a secondary catch 60. The secondary catch 60 remains engaged to prevent full opening of the hood 14 until the secondary handle 32 is actuated. The example latch release system 15 includes the first handle 28 and an emergency handle 30 that are coupled to a common link 26. The common link 26 is a split Bowden cable that includes a first end 48 attached to actuate the primary catch 58. A second end 50 is attached to the first handle 28 that is disposed and accessible from within the vehicle cabin 18. A third end 52 of the cable 26 is coupled to the emergency handle 30 that is accessible from within the front compartment 12.

Upon actuation of the first handle 28 or the emergency handle 30, the primary catch 58 is released and the hood 14 will move to an initial open position. In the initial open position, the hood 14 is not openable as it is still limited in movement by the secondary catch 60. Further actuation of the first handle 28 or the emergency handle 30, does not release the secondary catch 60. Accordingly, the vehicle must be brought to a stop and the operator must exit the vehicle cabin 18 to access the secondary handle 32 disposed within the closable compartment 16.

In this example, the closable compartment 16 is a compartment that includes a charging port 56. Although the example second handle 32 is disclosed as being accessible through the charging compartment 16, other locations on the vehicle accessible from outside of the vehicle cabin only could also be utilized and are within the contemplation of this disclosure. Pulling of the second handle 32, actuates the secondary latch 24 to pull the secondary latch 60 in a direction that releases it from the catch 46 to enable fully opening of the hood 14.

The example latch release system 15 may also be actuated at least partially through a power actuator 42 powered through an onboard power source such as battery 44. In this example, the powered actuator 42 is coupled to the primary latch 22 and receives signals from a controller 40 in response to actuation of switches 36 or 38. The switch 36 is actuated in response to pulling of the first handle 28. Actuation of the switch 38 is caused by pulling of the emergency handle 30. In both instances, actuation of the switches 36 and 38 signals the controller 40 to control the actuator 42 to release the primary latch 22. The secondary latch 24 is not accessible or actuated by the powered actuator 42 and requires an operator to exit the vehicle cabin 18 and access the secondary handle 32 through the closure panel 16. In this way, further control sensors or systems are not required that determine a vehicle speed and disable unlatching of the secondary latch. The secondary latch 24 is only releasable by manually releasing or pulling on the secondary handle 32.

Figure 3:
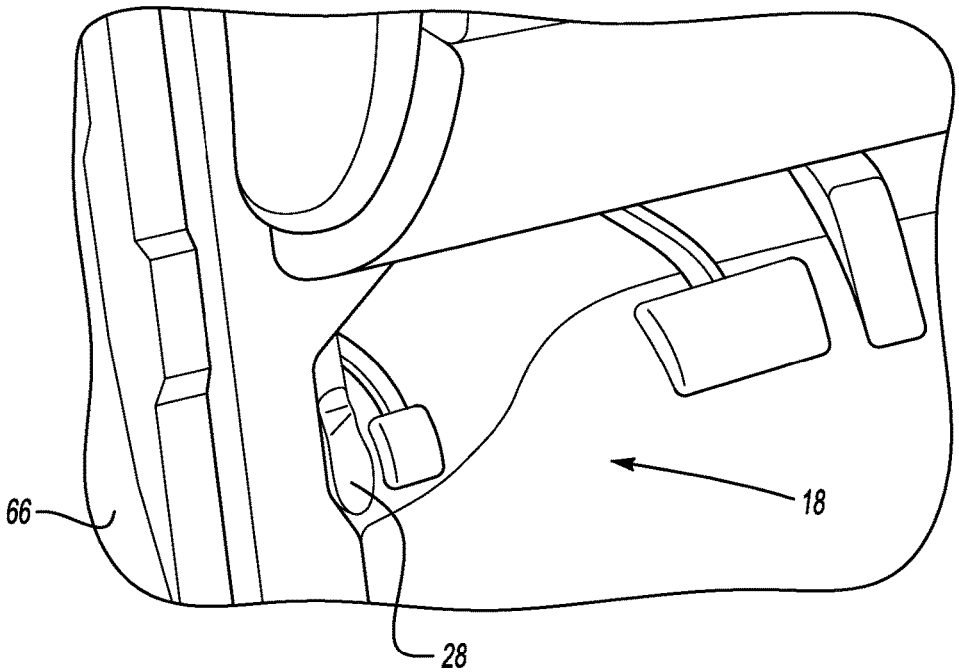
FIG. 3 is a perspective view of an interior of a vehicle cabin including a first latch release handle.
Figure 4:
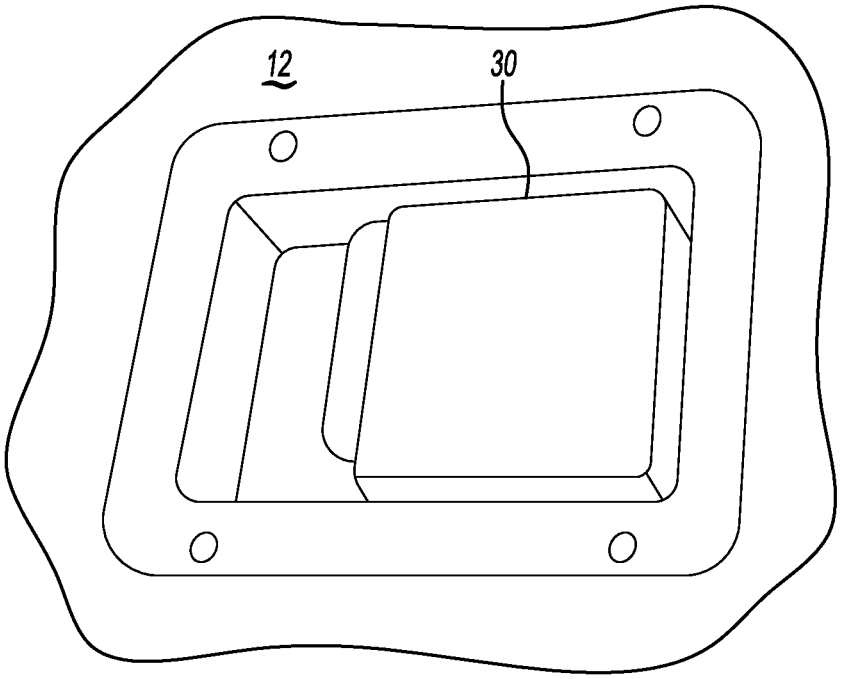
FIG. 4 is a perspective view of an emergency release handle.

Referring to FIGS. 3 and 4 with continued reference to FIG. 1, the first handle 28 is disposed within the vehicle cabin 18 in the location that is blocked when the vehicle door 66 is closed. Because the vehicle door 66 blocks actuation of the first handle 28, the handle 28 may only be actuated when the vehicle 10 is in a parked non-moving condition.

The emergency handle 30 is accessible from within the compartment 12 and may manually actuate the primary latch or cause the switch 38 to prompt the controller 40 to unlatch the primary catch 22. However, the trunk 14 is not fully openable from within the front compartment 12. The secondary latch 24 is not openable from within the compartment 12 to prevent opening when the vehicle is above a predetermined speed threshold.

Figure 5:
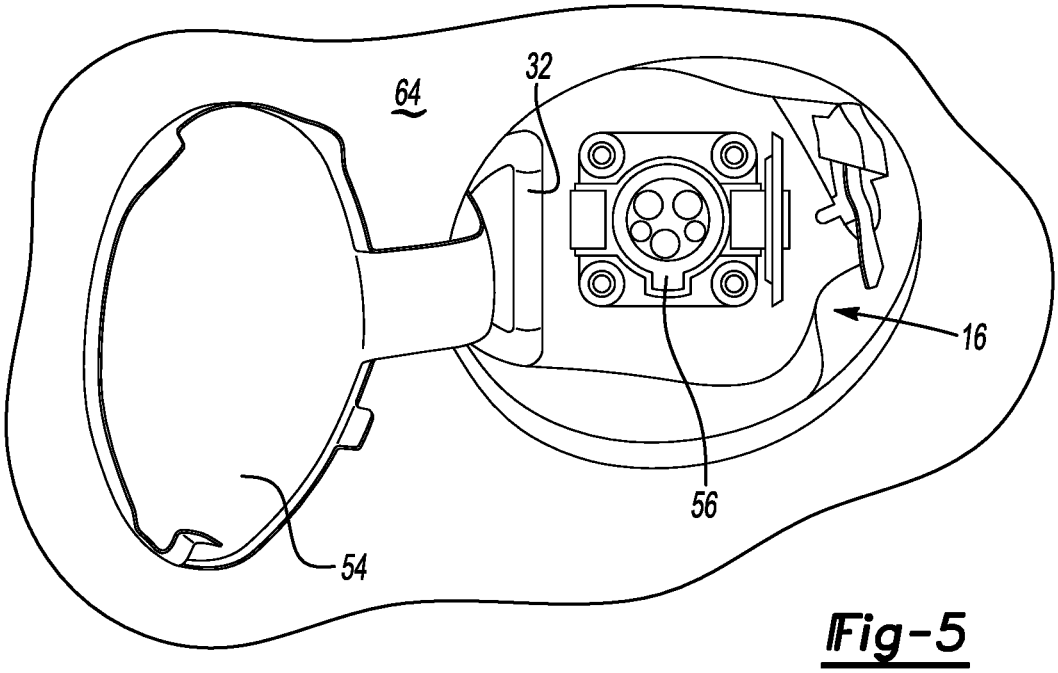
FIG. 5 is a perspective view of a closable compartment accessible from outside the vehicle cabin.

Referring to FIG. 5 with continued reference to FIG. 2, the example closable compartment 16 includes the charging port 56 and the handle 32. A hatch 54 is closable over the compartment 16. The hatch 54 may be openable from a lever within the vehicle cabin or may also be openable from an external location outside the vehicle 10. The example compartment 16 is one example of a location where the secondary handle 32 may be located. Other locations apart from the latch assembly 20 could also be utilized and are within the contemplation of this disclosure.

Because the secondary handle 32 only actuates the secondary latch 24, it cannot be utilized to fully open the hood 14. Accordingly, the hood 14 can only be opened by actuating both a handle within the vehicle cabin or within the compartment and the externally accessible secondary handle 32. Because both the first handle 28 and the secondary handle 32 must be actuated to release the hood 14, the possibility of opening the front hood 14 from outside the vehicle is prevented.

Figure 6:
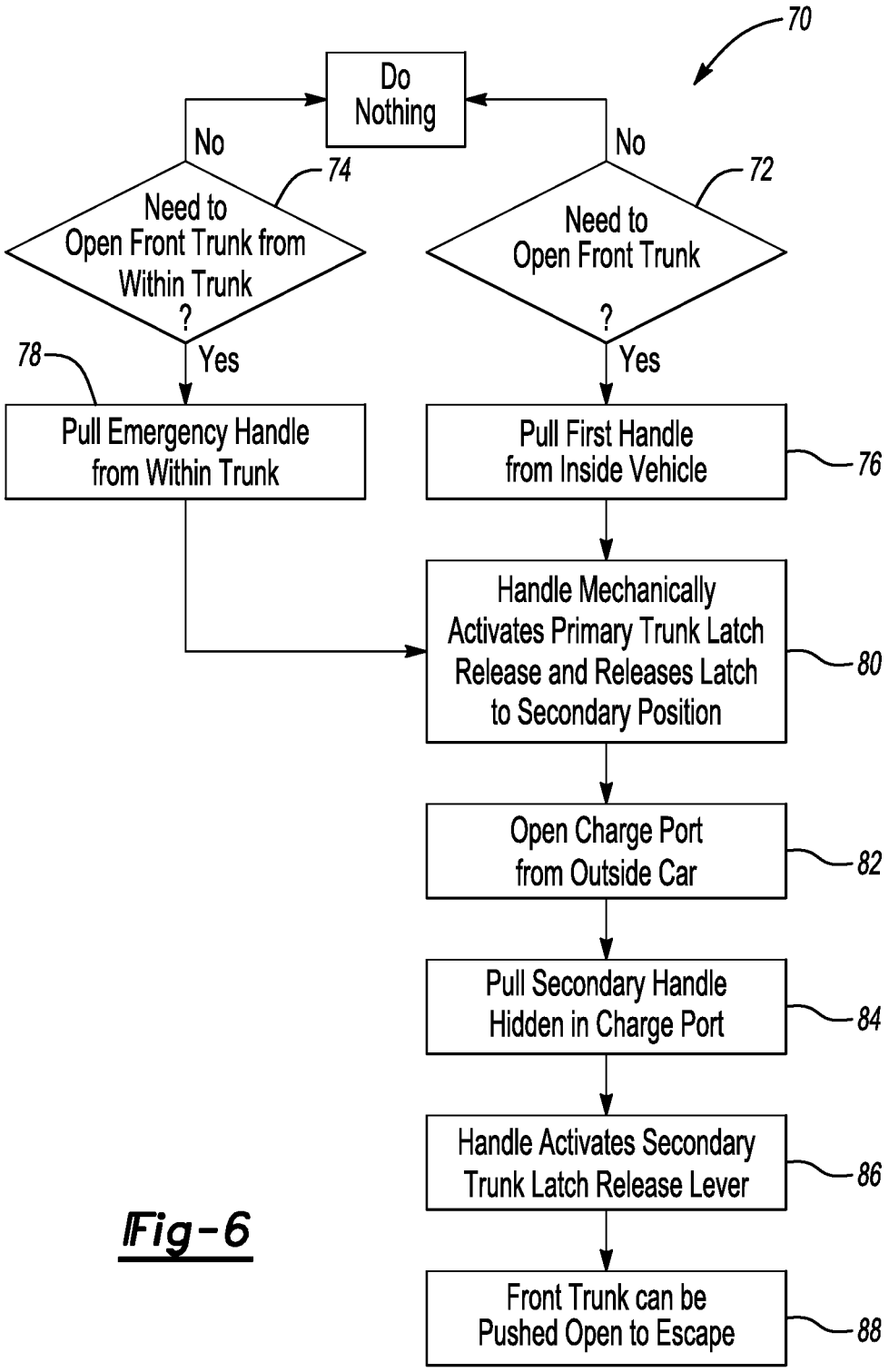
FIG. 6 is a flow diagram illustrating operation steps of the example front hood latch release system.

Referring to FIG. 6 with continued reference to FIG. 1, an example method of operating the example disclosed front hood release system is schematically illustrated at 70 and includes a first sequence of steps 72 applicable under a first condition. The example first condition includes instances when a driver or occupant of the vehicle 18 may access the vehicle cabin 18 and is not present within the front compartment 12. When it is desired to open the front hood 14, the first handle 28 is pulled from inside the vehicle 18 as is indicated at 76. The first handle 28 mechanically activates the primary latch 22 and releases the catch 46 to a position where the secondary catch 60 of the secondary latch 22 is holding the hood 14 in the initial open position as indicated at 80. The operator must then exit the vehicle, open the closable compartment 16 as is indicated at 82 and pull the secondary handle 32 that is within that compartment 16 as is indicated at 84. Pulling of the secondary handle 32 releases the secondary latch 60 enabling opening of the front hood 14 to a fully open position as indicated at 86.

If a passenger is trapped within the compartment 12 and the front trunk needs to be opened according to a second sequence of the steps shown at 74. The second sequence of steps 74 is a slightly different process. An occupant within the front compartment 12 will pull on the emergency handle 78 to actuate the primary latch 22 and release the primary catch 58. Releasing of the primary latch 22 does not allow full opening of the front hood 14 but does move the hood 14 to the first initial open position. The first open position unseals the front hood and allows airflow into the front compart 12 through the partially open front hood 14. The remaining steps are the same as required for the first sequence of steps 72. Someone is required to pull the secondary handle 32 from outside vehicle. Because the secondary handle 32 is not accessible from outside the vehicle 10 there is no need for additional structure or control functions to prevent opening of the hood 14 from within the vehicle 10 when the vehicle is moving.

Accordingly, the example front hood release system 15 simplifies operation and assembly by preventing opening of the hood 14 without operation of a secondary handle 32 accessible only from outside the vehicle 10.

Although the different non-limiting embodiments are illustrated as having specific components or steps, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A front hood latch release system comprising:

a front hood covering a forward compartment of a vehicle;

a primary latch and a secondary latch securing the front hood over the forward compartment;

a first handle disposed within a vehicle cabin and linked to actuate the primary latch;

an emergency handle disposed within the forward compartment covered by the front hood, the emergency handled coupled to the primary latch and configured to actuate the primary latch;

a secondary handle accessible from outside the vehicle cabin, the secondary handle coupled to the secondary latch and configured to actuate the secondary latch, wherein the secondary handle is disposed within a closable compartment separate from the forward compartment and accessible from outside the vehicle cabin.

2. The front hood latch release system as recited in claim 1, wherein the first handle and the emergency handle are coupled to a common link for actuating the primary latch.

3. The front hood latch release system as recited in claim 2, wherein the common link comprises a split Bowden cable including a first end attached to the primary latch, second end attached to the first handle and a third end attached to the emergency handle.

4. The front hood latch release system as recited in claim 1, wherein the secondary latch is actuated only by the secondary handle.

5. The front hood latch release system as recited in claim 1, wherein the secondary handle comprises a t-shaped handle coupled to the secondary latch through a flexible link.

6. The front hood latch release system as recited in claim claim 1, wherein the closable compartment covers a charging port.

7. The front hood latch release system as recited in claim 1, wherein a Bowden cable is linked between the emergency handle and the secondary latch.

8. The front hood latch release system as recited in claim 1, wherein the primary latch releases the front hood only to a partial open position and the secondary latch releases the front hood to allow complete opening of the front hood such that the front hood may be moved to a fully open position only upon release of both the primary latch and the secondary latch.

9. The front hood latch release system as recited in claim 1, including a powered actuator coupled to the primary latch, wherein the first handle and the emergency handle comprise switches for actuating the actuator to release the primary latch.

10. The front hood latch release system as recited in claim 9, including a controller coupled to the powered actuator and the switches of both the first handle and the emergency handle for controlling release of the primary latch with the powered actuator.

* * * * *